US012588720B2

(12) United States Patent
Arslan

(10) Patent No.: US 12,588,720 B2
(45) Date of Patent: Mar. 31, 2026

(54) IMPACT PROTECTOR

(71) Applicant: THEOKO GMBH, Reinach (CH)

(72) Inventor: Oktay Arslan, Reinach (CH)

(73) Assignee: THEOKO GMBH, Reinach (CH)

( * ) Notice: Subject to any disclaimer, the term of this patent is extended or adjusted under 35 U.S.C. 154(b) by 1 day.

(21) Appl. No.: 18/720,114

(22) PCT Filed: Dec. 15, 2022

(86) PCT No.: PCT/EP2022/086029
§ 371 (c)(1),
(2) Date: Jun. 14, 2024

(87) PCT Pub. No.: WO2023/111124
PCT Pub. Date: Jun. 22, 2023

(65) Prior Publication Data

US 2025/0040634 A1 Feb. 6, 2025

(30) Foreign Application Priority Data

Dec. 15, 2021 (EP) ..... 21214823

(51) Int. Cl.
*A41D 13/05* (2006.01)

(52) U.S. Cl.
CPC ..... *A41D 13/0543* (2013.01)

(58) Field of Classification Search
CPC ..... A63B 71/1225; A63B 2209/18; A63B 2209/2071; A63B 2209/1258; A41D 13/0543; F41H 5/007; F41H 5/02; F41H 5/04; F41H 5/08
See application file for complete search history.

(56) References Cited

U.S. PATENT DOCUMENTS 1,318,600 A * 10/1919 Saddlemire ..... E06B 3/485 2/2.5
1,513,766 A * 11/1924 Spooner ..... F41H 1/02 152/196
2015/0275528 A1 10/2015 Muehlebach
(Continued)

FOREIGN PATENT DOCUMENTS

CH 604 587 A5 9/1978
DE 30 11 566 A1 10/1981
(Continued)

OTHER PUBLICATIONS

Anonymous: "Blutgrätsche—The Index Project,", Dec. 31, 2019, XP055927240, https://theindexproject.org/award/nominees/3651, retrieved Jun. 1, 2022.
(Continued)

*Primary Examiner* — Katherine M Moran
(74) *Attorney, Agent, or Firm* — MEDLER FERRO WOODHOUSE & MILLS PLLC

(57) ABSTRACT

The present invention is directed to an impact protector (1), in particular for protection against external forces, comprising a base body (2) with an inner side (5) and an outer side (6). The base body (2) is preferably convexly curved outwards. The base body (2) is made of a cork material, in particular a pressed cork material. Furthermore, the invention relates to a textile holding device with an impact protector according to the invention.

18 Claims, 10 Drawing Sheets

(56) References Cited

U.S. PATENT DOCUMENTS

| | | | | |
|---|---|---|---|---|
| 2017/0354861 | A1* | 12/2017 | Pärssinen ..... | A63B 71/1225 |
| 2019/0184263 | A1 | 6/2019 | Porte et al. | |

FOREIGN PATENT DOCUMENTS

| | | | |
|---|---|---|---|
| DE | 10 2010 035226 | A1 | 3/2012 |
| DE | 20 2015 002030 | U1 | 4/2015 |
| EP | 1 369 149 | A1 | 12/2003 |
| WO | 99/00161 | A1 | 1/1999 |
| WO | 2005120262 | A1 | 12/2005 |

OTHER PUBLICATIONS

Written Opinion and International Search Report issued Mar. 16, 2023 in Intl. Appl. No. PCT/EP2022/086029.

* cited by examiner

IMPACT PROTECTOR

TECHNICAL FIELD

The invention relates to an impact protector according to the preamble of independent claim 1. Furthermore, the invention relates to a textile holding device with an impact protector according to the invention.

Such impact protectors include in particular shin guards, which are sometimes also referred to as shin protectors, leg splints, lower leg protectors or lower leg guards and belong to the field of sports protective equipment. These primarily serve to protect the shinbone against external violent effects caused by forces that occur in combats, collisions or impact situations. Typical sports in which impact protectors are regularly used include soccer, Futsal, American football, field hockey, ice hockey, cricket, motorsports, cycling and combat sports. However, the protectors can also be used for all other parts of the body, such as shoulders, hips, thighs, chest, back/spine, genital region, abdomen, hand, head or elbows. Such impact protectors are usually made of plastic and/or foam material.

On the other hand, such impact protectors are also used in the medical field, for example as hip protectors, arm protectors, leg protectors, shoulder protectors, back protectors, etc., which are used in hospitals or in retirement and nursing homes to protect patients in the event of a fall as a preventative measure. Another area of application for impact protectors is physiotherapy.

PRIOR ART

For example, DE 30 11 566 A1 discloses lower leg guards, in particular shin guards for athletes. These consist of a shell made of plastic material that covers the regions of the leg to be protected. This shell consists of two different plastic materials of different hardness, one material serving as the actual impact protection zones and these impact protection zones being overmolded with the second material. The actual impact protection zones are made of the harder plastic material, such as polypropylene, and the surrounding parts are made of the less hard plastic material, such as polyurethane foam.

Such lower leg guards have proven to be useful in practice, but they are made of materials that are not very environmentally friendly, so there is potential for improvement, especially with regard to the increasingly important issue of sustainability. In addition, the plastic materials used for the well-known shin guards can cause allergies in users, so there is a need for innovative products in this regard too. In addition, many athletes find impact protectors made of plastic to be restrictive or uncomfortable to wear.

The object of the present invention is therefore to propose an impact protector which has at least a comparable protective effect as, for example, the known impact protectors, but which can also be produced from recyclable and non hazardous material and which has an increased wearing comfort.

PRESENTATION OF THE INVENTION

The object is achieved according to the invention by an impact protector as defined in independent claim 1. Advantageous embodiments of the invention emerge from the dependent claims.

The essence of the invention is as follows: An impact protector, which serves in particular to protect against external forces. The impact protector has a base body with an inner side and an outer side. The base body is preferably convexly curved outwards. The base body is made of a cork material, in particular a pressed cork material.

The term "inner side" means the side of the base body facing the part of the body to be protected, such as the shin, of the user.

The term "outer side" means the side of the base body facing away from the part of the body to be protected, such as the shin, of the user.

The term "cork material" means any material consisting of cork bark, cork crust, cork chips, cork pieces and cork waste. The impact protector can basically be made or punched out of cork bark in one piece or it can consist of multiple parts/particles which may be glued and/or pressed together.

The term "pressed cork material" refers in particular to cork material made from granules which are mixed with a binding agent and pressed. Embodiments are also conceivable in which the cork granules are mixed with an elastomeric material, such as rubber.

The convex curvature of the base body can vary depending on the application. However, non-curved shapes for the base body are also conceivable, which are essentially plate-like.

Preferably, the base body is made of a fully pressed cork material. The term "fully pressed" means that the base body consists only of a single layer of pressed cork material.

In an alternative embodiment of the invention, the base body is formed from multiple layers of a pressed cork material (namely in particular a pressed cork material), wherein the multiple layers of pressed cork material are preferably glued together. In the case of, for example, three layers (or plies), a respective adhesive layer would be provided between the inner and middle layer/ply and between the middle and outer layer/ply, which adhesive layer would preferably be formed from a solvent-free contact adhesive (e.g. D310). In particular, two, three, four, five, six, seven, eight, nine or ten or more plies/layers may be provided.

Both of the aforementioned designs ensure particularly pronounced absorption, insulation and distribution or diversion of external forces. In addition, a strong degree of breakage inhibition and breakage resistance can be achieved. Furthermore, the elasticity of the impact protectors can generally be increased as well as their stability, especially with regard to optimal compressive strength, tensile strength and tear resistance.

Preferably, the base body has on its inner side a contact structure formed from a plurality of first structural elements protruding from the inner side of the base body, which is preferably configured to prevent the impact protector from slipping relative to the respective body part to be protected. However, a certain degree of mobility, for example during strong or extreme movements, should always be guaranteed. In addition, the contact structure can increase elasticity, prevent cracking and divert forces in a targeted manner.

Preferably, the first structural elements are designed as round, oval, triangular, square, rectangular, pentagonal, hexagonal and/or polygonal structural elements. These geometries have proven to be particularly efficient; they can also be combined depending on the body part and/or sport in order to achieve special adhesion or gliding properties. Preferably, the first structural elements have a substantially flat upper side, which rests, for example, on the shinbone.

Preferably, the first structural elements protrude from 1 mm to 5 mm, preferably from 2 mm to 4 mm, more preferably from 2.5 mm to 3.5 mm from the inner side of the base body. These distances have proven to be particularly practical, as they ensure a certain amount of air circulation and allow sweat to drain away more easily. In addition, this allows an optimal flow of forces, i.e. the forces can be optimally diverted or distributed.

Preferably, the inter-element distances between the individual first structural elements are from 2 mm to 20 mm, preferably from 3 mm to 18 mm, more preferably from 4 mm to 15 mm and even more preferably from 5 mm to 10 mm. In this case, "inter-element distance" means the smallest distance between two adjacent structural elements (or their outer periphery). This can further improve the aforementioned advantages in terms of height distances. The first structural elements preferably occupy 30% to 90%, preferably 40% to 80%, more preferably 50% to 70% of the surface of the inner side of the base body.

Preferably, the base body has on its outer side a protective structure formed from one or more second structural elements protruding from the outer side of the base body, which protective structure is preferably configured to increase the strength of the impact protector. On the one hand, this can increase impact protection, and on the other hand, it can also increase the overall stability of the impact protector, e.g. to prevent accidental breakage. In addition, the protective structure can also increase elasticity, prevent cracking and divert forces in a targeted manner. The plurality of second structural elements usually have the same or similar geometries as the first structural elements.

Preferably, a (single) second structural element is provided, which is arranged centrally on the outer side of the base body and which preferably runs substantially parallel to the longitudinal sides and/or the transverse sides of the impact protector. This allows particularly effective impact protection and particularly high stability to be achieved.

Preferably, the single second structural element or the plurality of second structural elements protrude from 1 mm to 8 mm, preferably from 2 mm to 6 mm, more preferably from 3 mm to 5 mm from the outer side of the base body. In this way, the protective effect and the flow of forces can be further improved. The inter-element distances in the second structural elements correspond to the inter-element distances in the first structural elements.

Preferably, the density of the cork material, in particular the pressed cork material, is between about 150 kg/m$^2$ and about 800 kg/m$^2$, preferably between about 170 kg/m$^2$ and about 500 kg/m$^2$, more preferably between about 190 kg/m$^2$ and about 400 kg/m$^2$ and even more preferably between about 200 kg/m$^2$ and about 300 kg/m$^2$. In these ranges, the deformability of the cork allows for particularly good impact protection and particularly good force absorption. Since cork is a material with air cells, it can be compressed to half (or even 70%) of its thickness, so that the external forces are deflected differently depending on the cork density (and thickness). In addition, the cork then springs back to its original shape. Cork also has particularly good insulating properties.

Preferably, the grain size of the cork material, in particular the pressed cork material, is from 0.025 mm to 10 mm, preferably from 0.3 mm to 5 mm and more preferably from 0.4 mm to 1 mm. With the corresponding grain sizes, the aforementioned effects can be further increased. However, depending on the region of the impact protector, the density and grain size can change or be adapted to meet specific requirements.

Preferably, the thickness of the base body is from 1 mm to 200 mm, preferably from 1 mm to 80 mm, more preferably from 1 mm to 12 mm, more preferably from 2 mm to 10 mm, more preferably from 3 mm to 8.5 mm and even more preferably from 4 mm to 6 mm. This results in optimal protection and at the same time optimal wearing comfort. Particularly in the case of impact protectors for the back and hip region, the base bodies can be made up of a plurality of plies/layers glued together, so that in extreme cases the base body can be up to 20 cm thick. In the case of shin guards, three plies/layers are preferably glued together, which normally results in a maximum thickness of approximately 12 mm. However, the same thicknesses can also be achieved with full pressing.

Polyurethane resins, phenolic resins (formaldehyde resin), melamine resins or vegetable resins are preferably used as binding agents for the cork material, in particular the pressed cork material. This ensures a particularly strong bond.

Preferably, the inner side and/or the outer side of the base body have a surface treatment in the form of multiple pre-sealing, printing, staining, impregnation, varnishing, glazing, oiling, waxing and/or engraving.

Preferably, a protective layer is applied, in particular laminated, to the outer side of the base body. This also applies if structural elements are present on the outer side of the base body. The protective layer is in particular made of a fiber and/or textile material, such as cotton or a similar material. Particularly preferred is the use of synthetic-free fiber and/or textile materials, i.e. materials that do not contain petrochemicals (however the use of composite materials with plastic materials is also conceivable).

Due to the preferably laminated protective layer, the impact protectors are more tear-resistant and durable, particularly against abrasion, since the protective layer is suitable for deflecting forces on the protector to a certain extent. The term "outer side" means the side of the base body facing away from the part of the body to be protected, such as the shin, of the user.

Preferably, the protective layer applied/laminated to the outer side of the base body has a layer thickness between 0.5 mm and 2.5 mm, more preferably between 0.75 mm and 2.25 mm and most preferably between 1 mm and 2 mm. In the case of hip protectors, the layer thickness can be between 1 mm and 20 mm.

The impact protectors according to the invention can be personalized by engraving or designed in color or black and white by printing. A choice of colored granules is also possible.

Cork as a raw material from a naturally renewable tree bark is not only advantageous for the production of the impact protectors according to the invention but is also particularly environmentally friendly, as plastic and synthetic materials can be dispensed with. In this way, a currently advantageous consumption trend can be promoted, including the promotion of values at all levels, namely from athletes to clubs and organizations or associations.

Finally, it should be noted that with conventional plastic shin guards, allergies, redness and itching often occur in the back of the knee or directly on the shin. In contrast, cork, as a naturally renewable raw material, does not cause any skin problems and is also odorless. Thanks to the suberin and ceroids contained in its cell walls, cork is practically impermeable to liquids, mites, bacteria, pests, rot, chemicals and gases. From a tactile and haptic point of view cork does not cause itching, and is free from mites and allergens. In addition, cork is barely noticeable when worn and its lightness supports a previously unknown level of freedom of movement during sports.

The impact protectors according to the invention can be worn directly on the skin or they can be inserted into a textile lining or into a textile holding device, such as a shirt, trousers, stockings, etc. In this regard, the textile holding device preferably has suitable pockets into which the impact protectors can be inserted. The impact protectors can also be sewn, embedded or welded into the textile holding device.

In a further aspect, the present invention comprises a textile holding device with an impact protector according to the invention. The textile holding devices can be made of natural or synthetic materials or fibers. In addition, they preferably have pockets into which the impact protectors can be inserted. The pockets can be open or sewn shut. They can also be closed with a zipper or Velcro® (hook and loop) fastener. In addition, the impact protectors can be welded into the textile holding device. The impact protectors can also be applied to the outer side of the textile holding device, for example sewn or glued on.

The impact protectors according to the invention can be manufactured as shin guards in the usual sizes and thicknesses and can also have different degrees of hardness (from soft to hard). Common size dimensions include XS (11 cm to 12 cm), S (12 cm to 13.5 cm), M (13.5 cm to 15 cm), L (15 cm to 16.5 cm), XL (16.5 cm to 18 cm) and XXL (18 cm to 19.5 cm). The most common thicknesses range from 3 mm to 8 mm. Depending on the size and pattern structure on the inner side and outer side, they can be manufactured differently.

BRIEF DESCRIPTION OF THE DRAWINGS

Further advantageous embodiments of the invention will become apparent from the following description of embodiments of the invention with the aid of the schematic drawing. In particular, an impact protector according to the invention is described in more detail below with reference to the accompanying drawings using exemplary embodiments. In the drawings.

WAY(S) OF CARRYING OUT THE INVENTION

Figure 1:
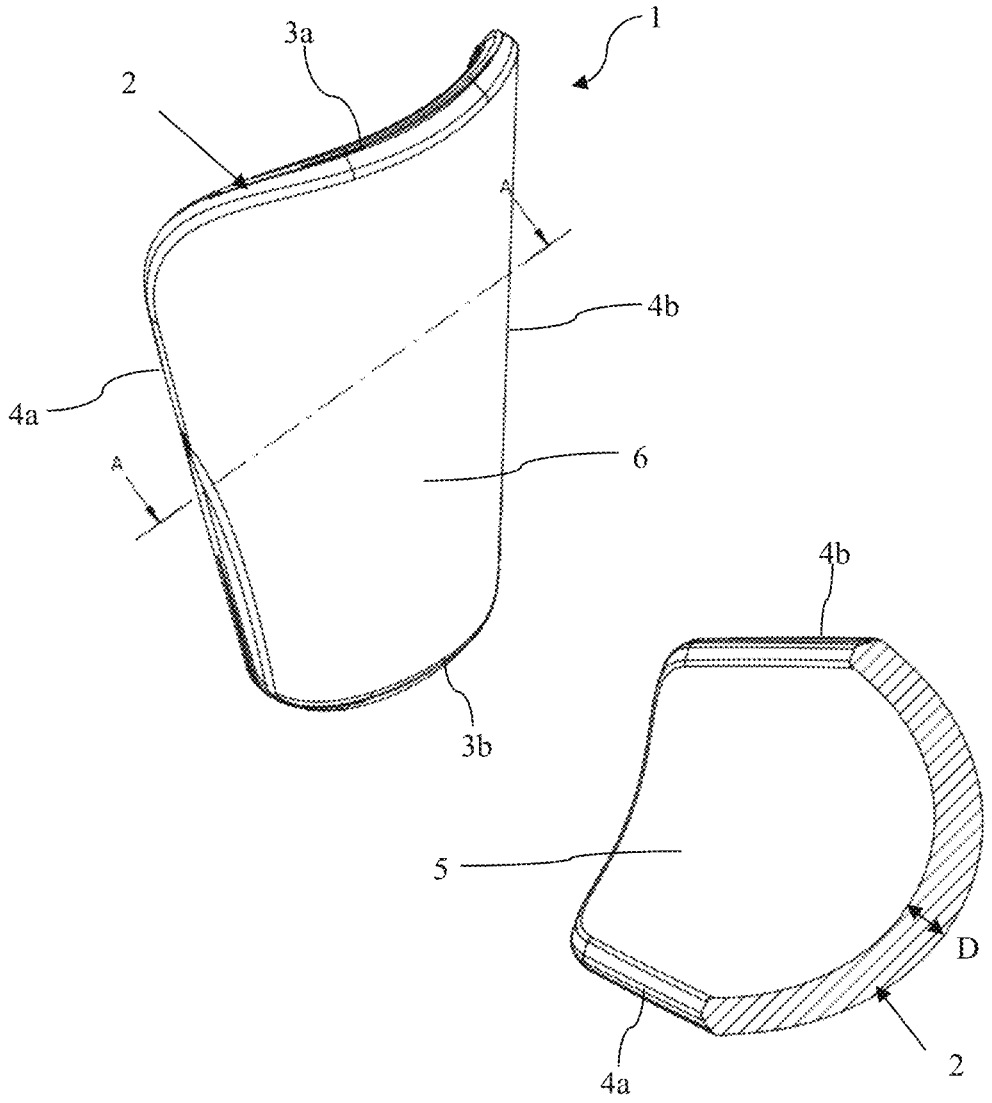
FIG. 1 shows a perspective view of an impact protector according to the invention with a fully pressed base body, as well as a sectional view of the same along line A-A.

Certain terms may be used in the following description for convenience only and are not intended to be limiting. The words "right", "left", "lower" and "upper" indicate directions in the drawing to which reference is made. The terms "inward", "outward" "below", "above", "left", "right" or similar are used to describe the arrangement of designated parts to each other, the movement of designated parts to each other and the directions to or from the geometric center of the invention, and named parts of the same as shown in the figures. These spatial relative specifications also comprise positions and orientations other than those shown in the figures. For example, if a part represented in the figures is reversed, elements or features described as "below" become "above". The terminology includes the words expressly mentioned above, derivatives thereof and words of similar meaning.

In order to avoid repetitions in the figures and the associated description of the various aspects and embodiments, certain features should be understood as common to different aspects and embodiments. The omission of an aspect in the description or a figure does not imply that this aspect is missing in the corresponding exemplary embodiment. Rather, such omission can serve to provide clarity and prevent repetition. In this context, the following definition applies to the entire further description: If reference numerals are included in a figure for the purpose of graphic clarity, but are not mentioned in the directly associated descriptive text, reference is made to their explanation in preceding figure descriptions. Furthermore, if the descriptive text directly associated with a figure contains reference numerals which are not contained in the associated figure, reference is made to the preceding and following figures. Similar reference numerals in two or more figures represent similar or identical elements.

FIG. 1 illustrates a perspective view of a first exemplary embodiment of an impact protector 1 with a fully pressed base body 2, as well as a sectional view of the same along line A-A. The base body 2 of the shin guard 1 has an upper side 3*a* and a lower side 3*b* (also called transverse sides) as well as a right side 4*a* and a left side 4*b* (also called longitudinal sides), wherein the longitudinal sides 4*a*, 4*b* run slightly wedge-shaped from the upper side 3*a* to the lower side 3*b*. The base body 2 is convexly curved from the inner side 5 to the outer side 6, wherein the curvature in the region of the upper side 3*a* tends to be somewhat more pronounced than in the region of the lower side 3*b*. The base body 2 has a thickness D which relates in particular to the middle part of the base body 2 and which is basically constant; however, embodiments are also conceivable in which the thickness D decreases slightly in the direction of the longitudinal sides 4*a*, 4*b*. The inner side 5 is essentially smooth; however, it may have a certain texture or roughness to increase the slip resistance.

Figure 2:
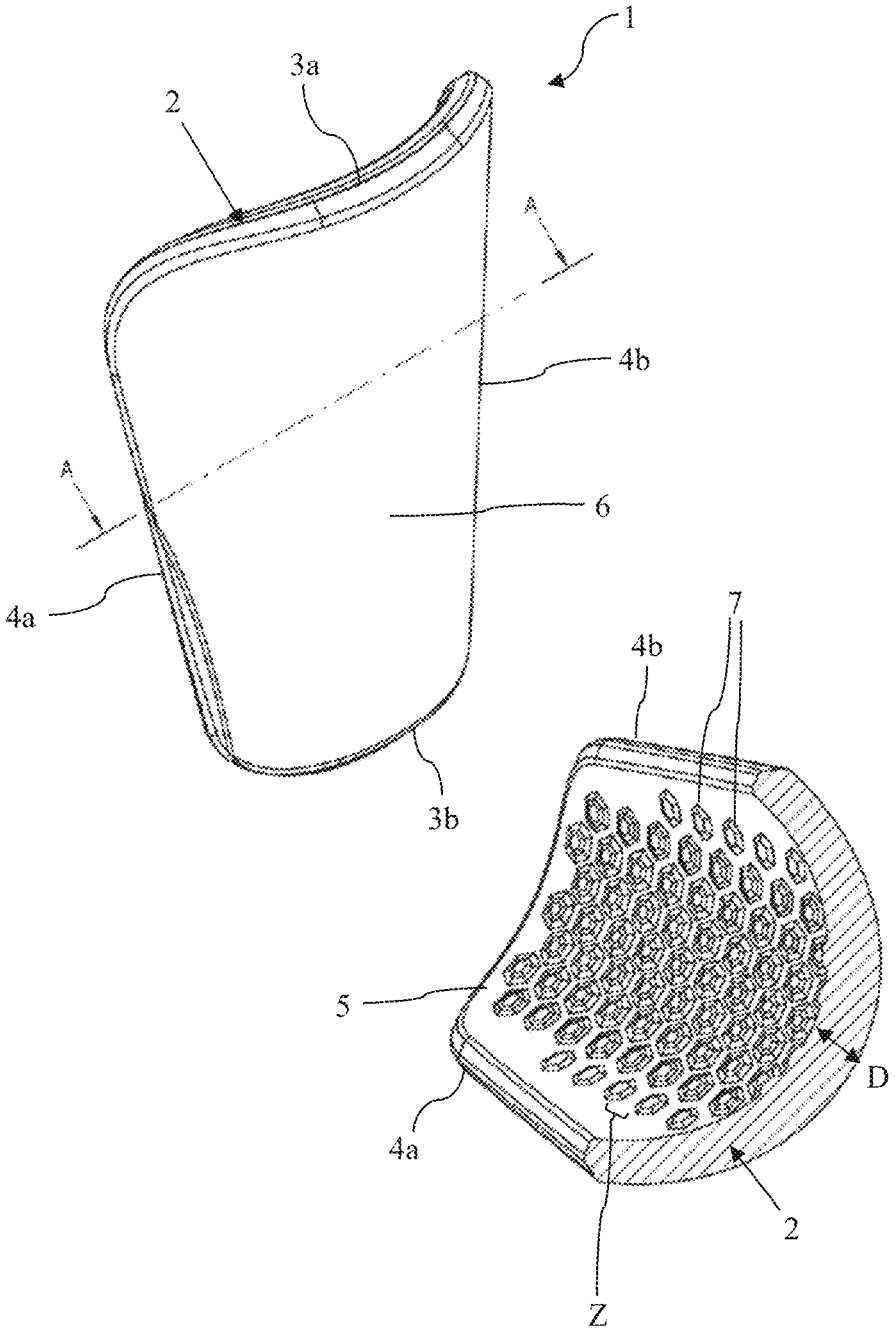
FIG. 2 shows a perspective view of an impact protector according to the invention with a fully pressed base body and a contact structure with multiple structural elements on the inner side, as well as a sectional view of the same along line A-A.

FIG. 2 illustrates a perspective view of a second exemplary embodiment of an impact protector 1 with a fully pressed base body 2. Here, the base body 2 has a contact structure with multiple structural elements 7 on the inner side 5, which are also intended to increase the slip resistance and also to ensure a certain air circulation and drainage of liquids such as sweat. In addition, this allows the forces to be optimally diverted or distributed. The thickness D refers to the thickness of the base body 2 without the height of the structural elements 7. The inner structural elements 7 are hexagonal in this embodiment and taper in the direction away from the inner side 5 in a frustoconical shape. The inter-element distance Z denotes the smallest distance between two adjacent structural elements 7 (from outer circumference to outer circumference). The inter-element distance Z can be smaller in the central region of the inner side 5 of the base body 2 than in the region of the long sides 4*a*, 4*b*.

Figure 3:
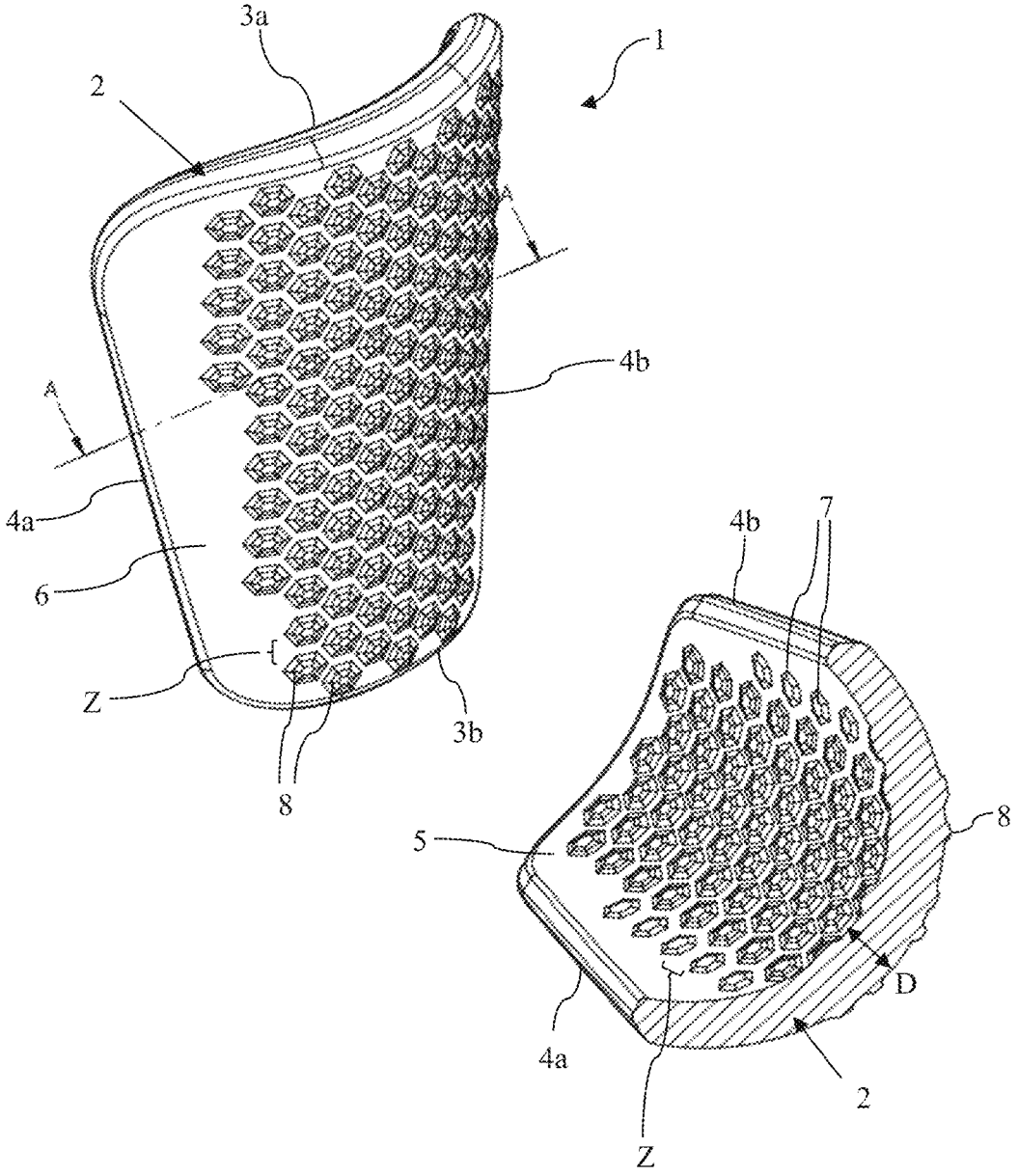
FIG. 3 shows a perspective view of an impact protector according to the invention with a fully pressed base body and a contact structure and a protective structure with multiple structural elements on the outer side, as well as a sectional view of the same along line A-A.

FIG. 3 shows a perspective view of a third exemplary embodiment of an impact protector 1 with a fully pressed base body 2 and a contact structure with multiple structural elements 7 on the inner side 5 as well as a protective structure with multiple structural elements 8 on the outer side 6, which represents the essential difference compared to the embodiment according to FIG. 2. In this embodiment, the outer structural elements 8 are also hexagonal and taper in the direction away from the outer side 6 in the shape of a truncated pyramid. The inter-element distance Z denotes the smallest distance between two adjacent structural elements 8 (from outer circumference to outer circumference). The inter-element distance Z can be smaller in the central region of the inner side 5 of the base body 2 than in the region of the long sides 4*a*, 4*b*. Due to the base body 2 tapering downwards in a wedge shape, more structural elements 8 are arranged in the region of the upper side 3*a* than in the middle region and more structural elements 8 are arranged in the middle region than in the region of the lower side 3*b*.

Figure 4:
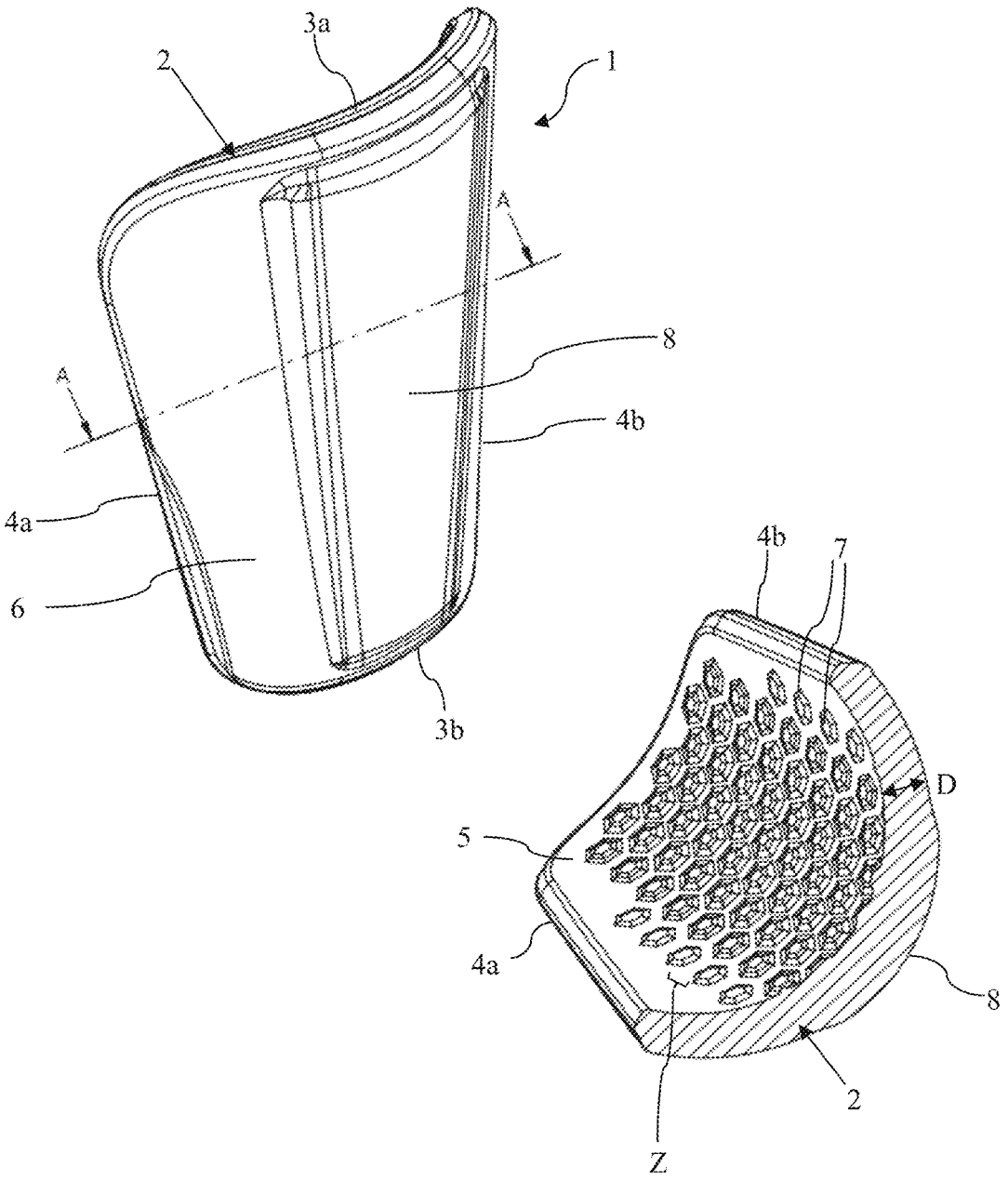
FIG. 4 shows a perspective view of an impact protector according to the invention with a fully pressed base body and a contact structure with multiple structural elements on the inner side, as well as a sectional view of the same along the line A-A.

FIG. 4 shows a perspective view of a fourth exemplary embodiment of an impact protector 1 with a fully pressed base body 2 and a contact structure with multiple structural elements 7 on the inner side 5 and a protective structure with only one structural element 8 on the outer side 6. The one structural element 8 protrudes further from the outer side 6 of the base body 2 than is the case with the plurality of structural elements 8 according to the previous embodiment (namely it can also have a thickness which corresponds to the thickness D of the base body 2) and it is arranged substantially centrally on the outer side 6 of the base body 2. This makes it possible to ensure even more efficient impact protection for the body part to be protected, such as the shinbone, i.e. in particular for forces acting essentially at right angles. The one structural element 8 converges from top to bottom in an approximately wedge shape, preferably substantially parallel to the longitudinal sides 4*a*, 4*b*. Its thickness may decrease slightly from top to bottom.

Figure 5:
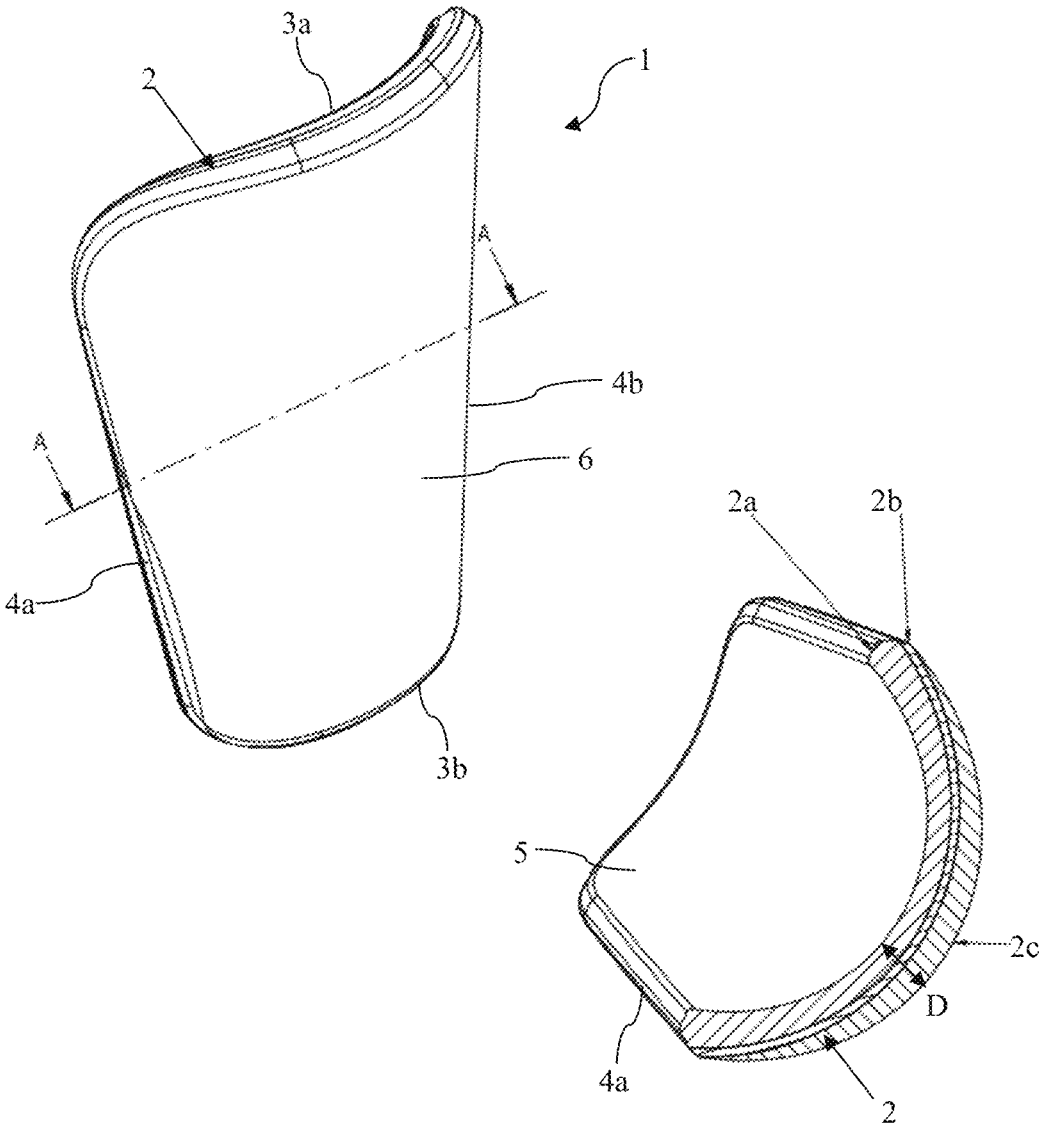
FIG. 5 shows a perspective view of an impact protector according to the invention with a three-layer base body and a sectional view of the same along line A-A.

FIG. 5 illustrates a perspective view of a first exemplary embodiment of an impact protector 1 with a fully pressed base body 2, as well as a sectional view of the same along line A-A. The base body 2 of the shin guard 1 has an upper side 3*a* and a lower side 3*b* (also called transverse sides) as well as a right side 4*a* and a left side 4*b* (also called longitudinal sides), wherein the longitudinal sides 4*a*, 4*b* run slightly wedge-shaped from the upper side 3*a* to the lower side 3*b*. In particular, the base body 2 is formed from three layers, namely an inner layer 2*a* comprising the inner side 5, a middle layer 2*b* and an outer layer 2*c* comprising the outer side 6. The inner layer 2*a* and the outer layer 2*c* are normally thicker than the middle layer 2*b*. The inner layer tends to become thicker in the direction of the long sides 4*a*, 4*b*, whereas the outer layer 2*c* tends to become thinner in the direction of the long sides 4*a*, 4*b*. The base body 2 is convexly curved from the inner side 5 to the outer side 6, wherein the curvature in the region of the upper side 3*a* tends to be somewhat more pronounced than in the region of the lower side 3*b*. The base body has a (total) thickness D which relates in particular to the middle part of the base body and which is basically constant; however, embodiments are also conceivable in which the thickness D decreases slightly in the direction of the longitudinal sides 4*a*, 4*b*. The (total) thickness D essentially corresponds to the thickness D according to the embodiment with the fully pressed base body (cf. FIGS. 1 to 4). The inner side 5 is also essentially smooth; however, it may have a certain texture or roughness to increase the slip resistance.

Figure 6:
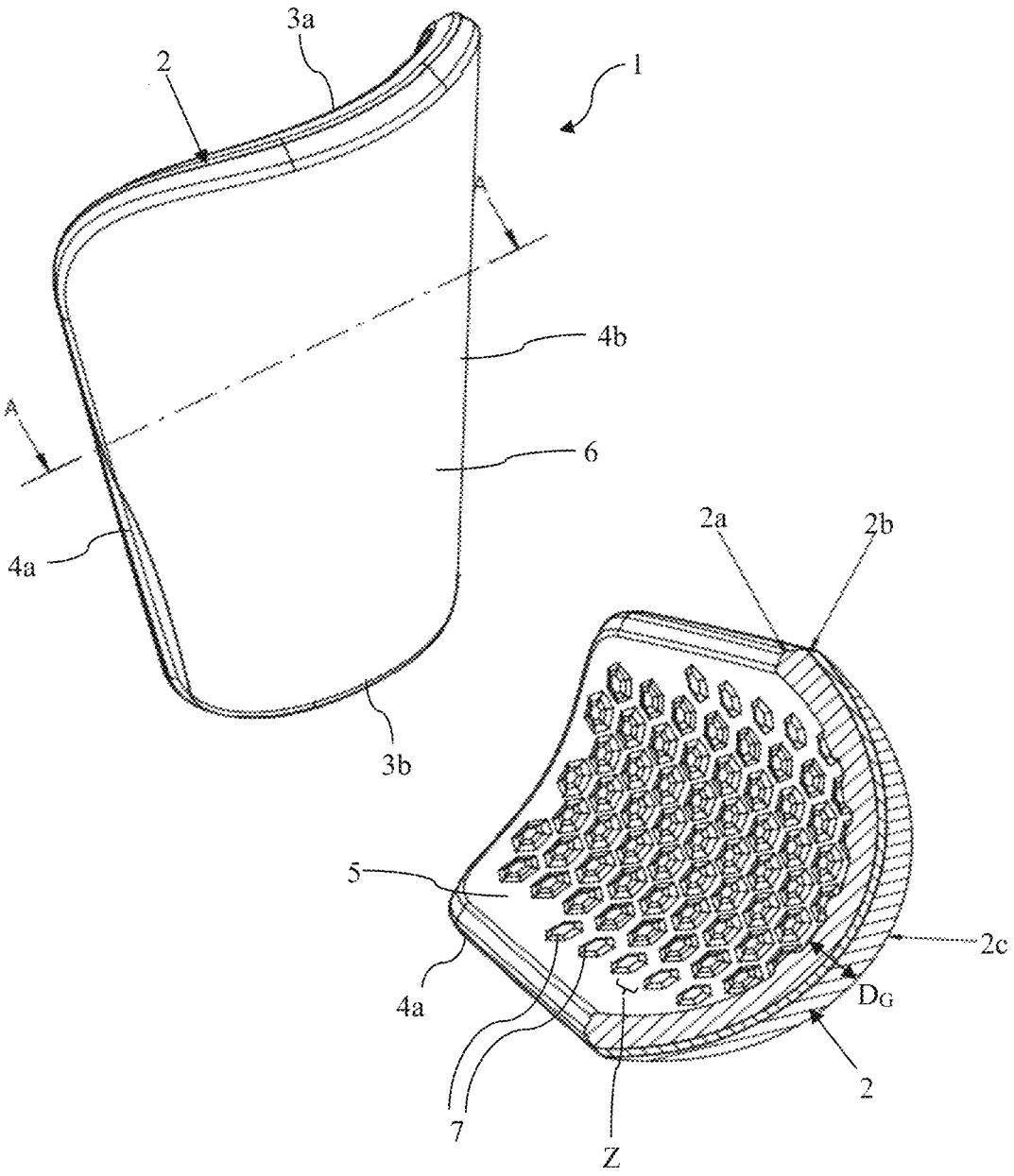
FIG. 6 shows a perspective view of an impact protector according to the invention with a three-layer base body and a contact structure with multiple structural elements on the inner side, as well as a sectional view of the same along line A-A.

FIG. 6 shows a perspective view of a second embodiment of an impact protector 1 with a three-layer base body 2. Here, the base body 2 has now also a contact structure with multiple structural elements 7 on the inner side 5 formed by the inner layer 2*a*, which is also intended to increase the slip resistance and also to ensure a certain air circulation and drainage of liquids such as sweat. The thickness $D_G$ refers to the (total) thickness of the base body 2 (namely of the three layers 2*a*, 2*b*, 2*c*) without the height of the structural elements 7. The inner structural elements 7 are hexagonal in this embodiment and taper in the direction away from the inner side 5 in a frustoconical shape. The inter-element distance Z denotes the smallest distance between two adjacent structural elements 7 (from outer circumference to outer circumference). The inter-element distance Z can be smaller in the central region of the inner side 5 of the base body 2 than in the region of the long sides 4*a*, 4*b*.

Figure 7:
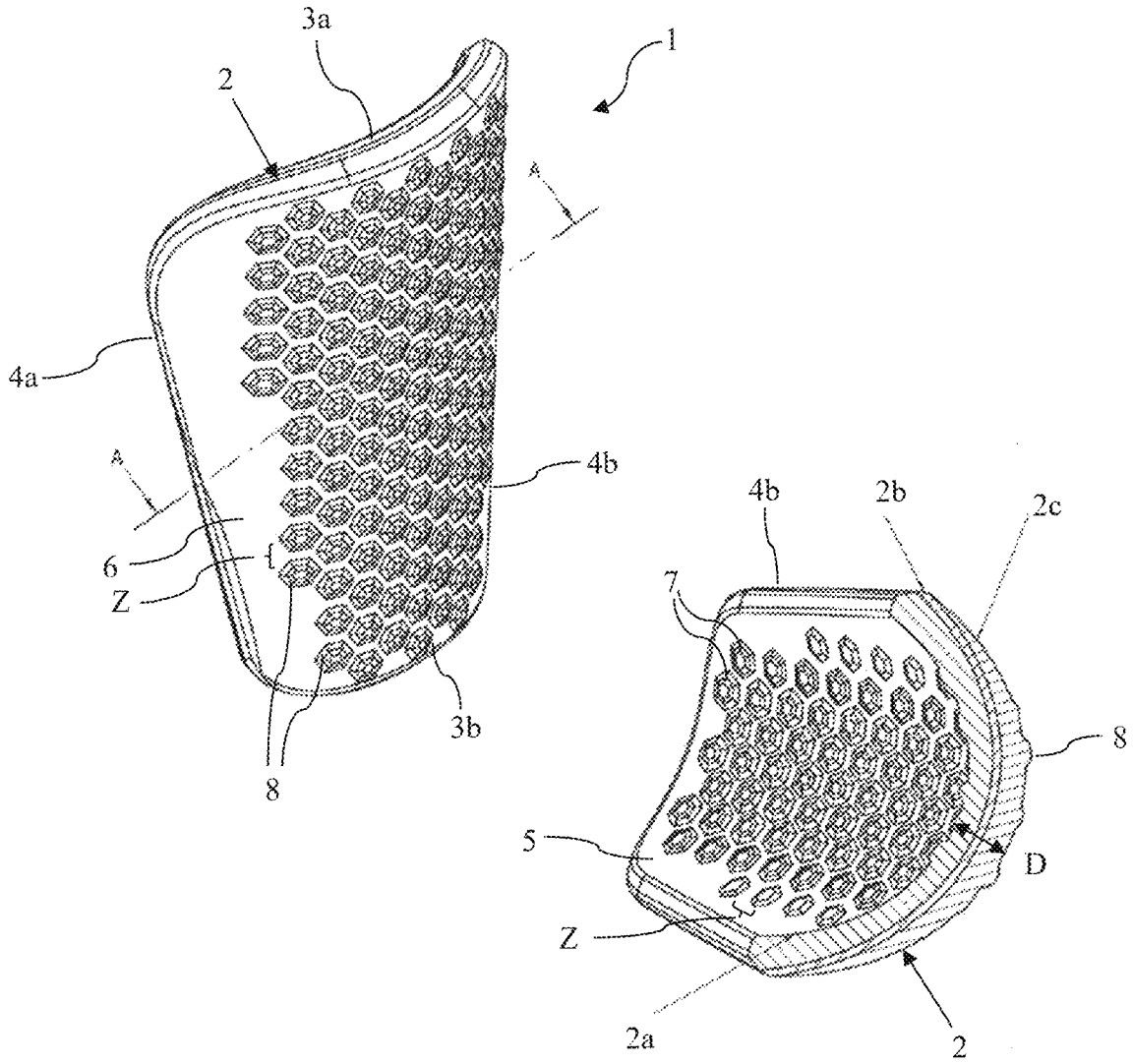
FIG. 7 shows a perspective view of an impact protector according to the invention with a three-layer base body and a contact structure with multiple structural elements on the inner side and a protective structure with multiple structural elements on the outer side, as well as a sectional view of the same along line A-A.

FIG. 7 shows a perspective view of a third exemplary embodiment of an impact protector 1 with a fully pressed base body 2 and a contact structure with multiple structural elements 7 on the inner side 5 formed by the inner layer 2*a* as well as a protective structure with multiple structural elements 8 on the outer side 6 formed by the outer layer 2*c*, which represents the essential difference compared to the embodiment according to FIG. 6. In this embodiment, the outer structural elements 8 are also hexagonal and taper in the direction away from the outer side 6 in the shape of a truncated pyramid. The inter-element distance Z denotes the smallest distance between two adjacent structural elements 8 (from outer circumference to outer circumference). The inter-element distance Z can be smaller in the central region of the outer side 6 of the base body 2 than in the region of the long sides 4*a*, 4*b*. Due to the base body 2 tapering downwards in a wedge shape, more structural elements 8 are arranged in the region of the upper side 3*a* than in the middle region and more structural elements 8 are arranged in the middle region than in the region of the lower side 3*b*.

Figure 8:
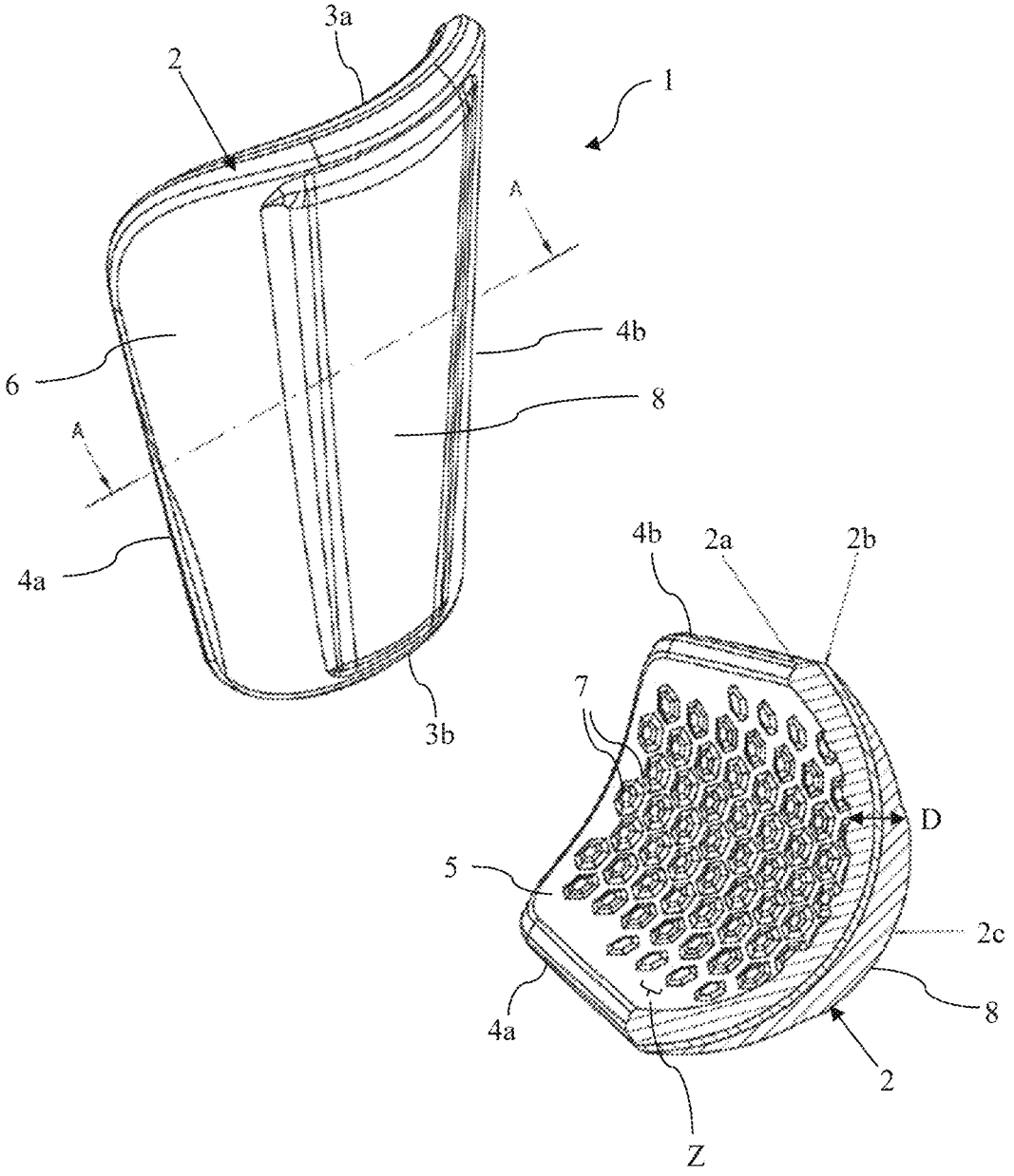
FIG. 8 shows a perspective view of an impact protector according to the invention with a fully pressed base body and a contact structure and a protective structure with multiple structural elements on the outer side, as well as a sectional view of the same along line A-A.

According to FIG. 8, a perspective view of a fourth exemplary embodiment of an impact protector 1 with a three-layer base body 2 and a contact structure with multiple structural elements 7 on the inner side 5 formed by the inner layer 2*a* and a protective structure with only one structural element 8 on the outer side 6 formed by the outer layer 2*c* is shown. The one structural element 8 protrudes further from the outer side 6 of the base body 2 than is the case with the plurality of structural elements 8 according to the previous embodiment (namely it can also have a thickness which corresponds to the thickness D of the base body 2) and it is arranged substantially centrally on the outer side 6 of the base body 2. This makes it possible to ensure even more efficient impact protection for the body part to be protected, such as the shinbone, i.e. in particular for forces acting essentially at right angles. The one structural element 8 converges from top to bottom in an approximately wedge shape, ie preferably substantially parallel to the longitudinal sides 4*a*, 4*b*. Its thickness may decrease slightly from top to bottom.

Figure 9:
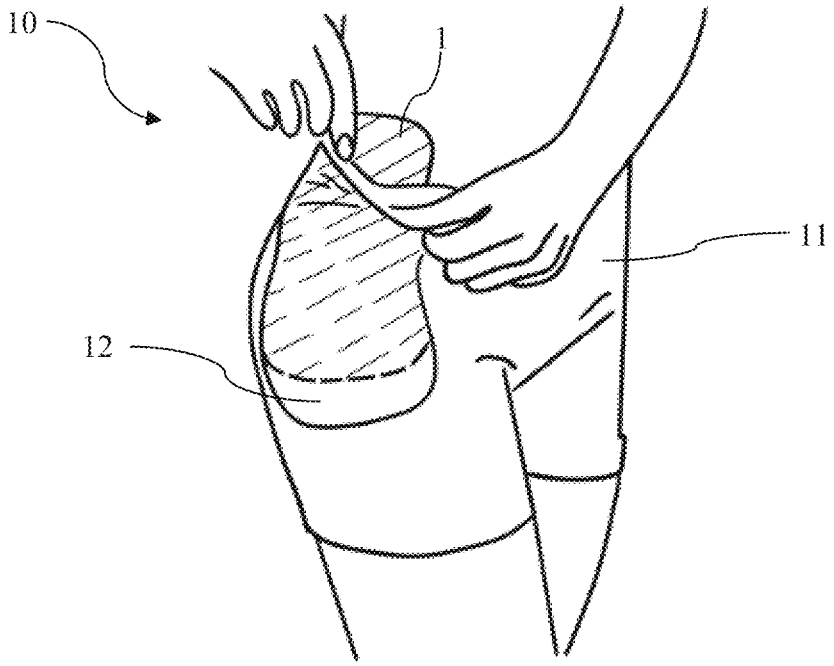
FIG. 9 shows an exemplary embodiment of a textile holding device into which an impact protector according to the invention is introduced as hip protection.

In FIG. 9, an exemplary textile holding device 10 in the form of underpants or support underpants 11 is shown, into which an impact protector 1 according to the invention is inserted as hip protection. The support underpants 11 have a pocket 12 on each side into which the hip protectors 1 can be inserted. The pockets 12 are preferably open, but they can also be sewn shut. They can also be closed with a zipper or Velcro® (hook and loop) fastener.

Figure 10:
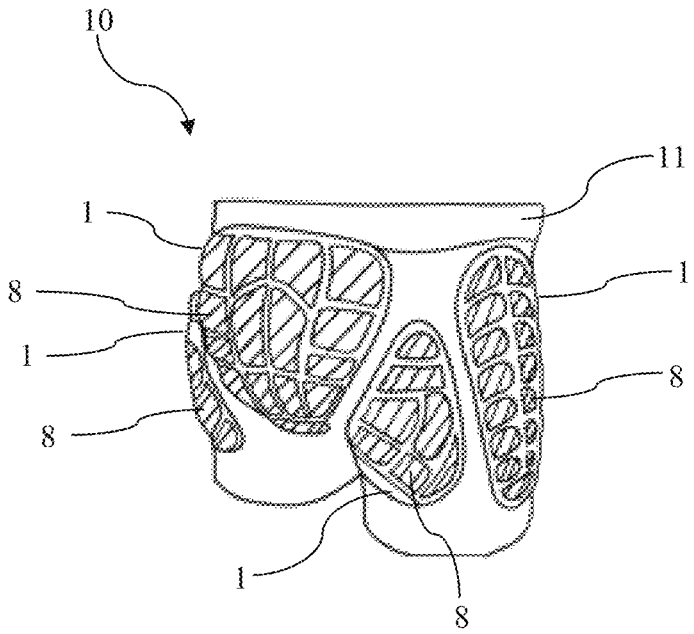
FIG. 10 shows an exemplary embodiment of a textile holding device to which impact protectors according to the invention are applied as hip, genital and groin protection.

In FIG. 10, another exemplary textile holding device 10 in the form of underpants or support underpants 11 is shown. Here, multiple impact protectors 1 according to the invention are applied to the outside of the support underpants 11 (i.e., sewn on or glued on). These include two groin protectors, two hip protectors and a genital protector. In this embodiment, the impact protectors 1 have only structural elements 8 for absorbing and dissipating the force flow on the outer side and a substantially smooth inner side.

The impact protectors 1 according to the invention can of course also be used for all other parts of the body, such as shoulders, thighs, chest, back/spine, abdomen, hand, head or elbows. It can also be used as a women's bra due to the high level of comfort provided by cork (wherein the cork material is on the inside and the textile material on the outer side), both as a sports bra and as a normal everyday bra.

Figure 11:
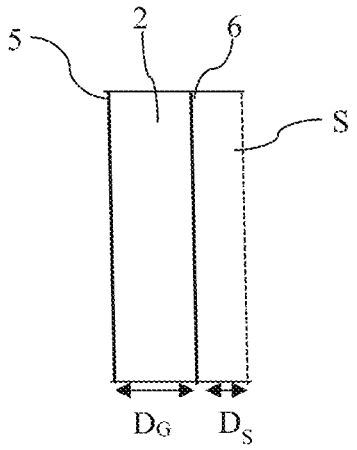
FIG. 11 shows a schematic side cross-sectional view of a part of a base body with a laminated layer of a carrier material.

Finally, FIG. 11 shows a schematic lateral cross-sectional view of a part of a base body 2 with an applied protective layer S. The protective layer S is preferably laminated onto the outer side 6 of the base body 2. This is also possible for embodiments in which external structural elements 8 are present on the outer side 6 of the base body 2 (as in FIGS. 3, 4, 7 and 8). The protective layer is in particular made of a fiber and/or textile material, such as cotton or a similar material. Particularly preferred is the use of synthetic-free materials, i.e. materials that do not contain petrochemicals (however the use of composite materials with plastic materials is also conceivable).

The protective layer S laminated onto the outer side 6 of the base body 2 generally has a layer thickness $D_S$ between 0.5 mm and 2.5 mm, preferably between 0.75 mm and 2.25 mm and even more preferably between 1 mm and 2 mm. In the case of hip protectors, the layer thickness $D_S$ can be between 1 mm and 20 mm. Preferably, the thickness $D_G$ of the base body is from 1 mm to 200 mm, preferably from 1 mm to 80 mm, more preferably from 1 mm to 12 mm, more preferably from 2 mm to 10 mm, more preferably from 3 mm to 8.5 mm and even more preferably from 4 mm to 6 mm.

Although the invention is illustrated and described in detail by means of the figures and the associated description, this illustration and this detailed description are to be understood as illustrative and exemplary and not as limiting the invention. In order not to obscure the invention, in certain cases well-known structures and techniques may not be shown and described in detail. It is understood that those skilled in the art may make changes and modifications without departing from the scope of the following claims. In particular, the present invention covers further exemplary embodiments with any combinations of features that may differ from the explicitly described combinations of features.

The present disclosure also comprises embodiments having any combination of features mentioned or shown above or below for various embodiments. It also includes individual features in the figures, even if they are shown there in connection with other features and/or are not mentioned above or below. The alternatives of embodiments described in the figures and the description and individual alternatives of their features may also be excluded from the subject matter of the invention or from the disclosed subject matters. The disclosure includes embodiments that exclusively include the features described in the claims or in the exemplary embodiments, as well as those that include additional other features.

In addition, the term "comprise" and derivations thereof do not exclude other elements or steps. Also, the indefinite article "a" or "an" and derivatives thereof do not exclude a large number. The functions of multiple features listed in the claims can be fulfilled by one unit or one step. The mere fact that certain measures are recited in mutually different dependent claims does not mean that a combination of those measures cannot be used to advantage. In particular, the terms "substantially," "approximately," "about," and the like in combination with a property or value define exactly the property or value. The terms "approximately" and "about" associated with a given number or range may refer to a value or range that is within 20%, 10%, 5%, or 2% of the given value or range. All reference numerals in the claims are not to be construed as limiting the scope of the claims.

LIST OF REFERENCE NUMERALS

1 impact protector
2 base body
2*a* inner layer
2*b* middle layer
2*c* outer layer
3*a* upper side (transverse side)
3*b* lower side (transverse side)
4*a* right side (long side)
4*b* left side (long side)
5 inner side
6 outer side
7 first structural elements (inner)
8 second structural element(s) (outer)
10 textile holding device
11 underpants or support underpants
12 pocket
$D_G$ thickness of base body
$D_S$ thickness of protective layer (laminate layer)
S protective layer
Z inter-element distance

The invention claimed is:

1. An impact protector, for protection against external forces, comprising:

a base body with an inner side and with an outer side, wherein the base body is convexly curved outwards, and the base body is formed from a cork material comprising a pressed cork material, wherein the density of the pressed cork material is between 150 kg/m$^2$ and 800 kg/m$^2$, and wherein the grain size of the pressed cork material is from 0.025 mm to 10 mm.

2. The impact protector according to claim 1, wherein the cork material of the base body is a fully pressed cork material.

3. The impact protector according to claim 1, wherein the pressed cork material of the base body includes multiple layers of the pressed cork material glued to one another.

4. The impact protector according to claim 1, wherein the base body has on its inner side a contact structure formed from a plurality of first structural elements protruding from the inner side of the base body, which is configured to prevent slipping of the impact protector relative to the respective body part to be protected.

5. The impact protector according to claim 4, wherein the plurality of the first structural elements having a shape selected from the group consisting of round, oval, triangular, square, rectangular, pentagonal, hexagonal and/or polygonal structural elements.

6. The impact protector according to claim 4, wherein the plurality of the first structural elements protrude from 1 mm to 5 mm, from 2 mm to 4 mm, or from 2.5 mm to 3.5 mm from the inner side of the base body.

7. The impact protector according to claim 4, wherein the inter-element distances (Z) between individual first structural element of the plurality of the first structural elements are from 2 mm to 20 mm, from 3 mm to 18 mm, from 4 mm to 15 mm, or from 5 mm to 10 mm.

8. The impact protector according to claim 1, wherein the base body has on its outer side a protective structure formed from one or more second structural elements protruding from the outer side of the base body, which protective structure is configured to increase the strength of the impact protector.

9. The impact protector according to claim 8, wherein a second structural element is provided which is arranged centrally on the outer side of the base body and runs substantially parallel to longitudinal sides and/or transverse sides of the impact protector.

10. The impact protector according to claim 8, wherein the one second structural element or the plurality of second structural elements protrude from 1 mm to 8 mm, from 2 mm to 6 mm, or from 3 mm to 5 mm from the outer side of the base body.

11. The impact protector according to claim 1, wherein the density of the pressed cork material is between 170 $kg/m^2$ and 500 $kg/m^2$, between 190 $kg/m^2$ and 400 $kg/m^2$, or between 200 $kg/m^2$ and 300 $kg/m^2$.

12. The impact protector according to claim 1, wherein the grain size of the pressed cork material is from 0.3 mm to 5 mm or from 0.4 mm to 1 mm.

13. The impact protector according to claim 1, wherein the thickness ($D_G$) of the base body is from 1 mm to 200 mm, from 1 mm to 80 mm, from 1 mm to 12 mm, from 2 mm to 10 mm, from 3 mm to 8.5 mm, or from 4 mm to 6 mm.

14. The impact protector according to claim 1, wherein polyurethane resins, phenolic resins, melamine resins or vegetable resins serve as binding agents for the cork material.

15. The impact protector according to claim 1, wherein the inner side and/or the outer side of the base body have a surface treatment in the form of one or more of pre-sealing, printing, staining, impregnation, painting, glazing, oiling, waxing and/or engraving.

16. The impact protector according to claim 1, wherein a protective layer(S) is applied to the outer side of the base body, wherein the protective layer(S) is formed from a fiber and/or textile material.

17. The impact protector according to claim 16, wherein the thickness of the protective layer ($D_S$) is between 0.5 mm and 2.5 mm, between 0.75 mm and 2.25 mm, or between 1 mm and 2 mm.

18. A textile holding device with at least one impact protector according to claim 1, wherein the textile holding device comprises at least one pocket for receiving the at least one impact protector or wherein the at least one impact protector is applied externally to the textile holding device.

* * * * *